United States Patent [19]

Wilkins et al.

[11] Patent Number: 5,040,856

[45] Date of Patent: Aug. 20, 1991

[54] COMESTIBLE STORAGE COMPARTMENT FOR REFRIGERATION UNIT

[75] Inventors: Allen L. Wilkins, Verona; Philip F. Hottmann, Cross Plains; Mark J. Blahnik, Sun Prairie, all of Wis.; Jerome Caruso, Lake Forest, Ill.

[73] Assignee: Sub-Zero Freezer Company, Inc., Madison, Wis.

[21] Appl. No.: 20,118

[22] Filed: Feb. 27, 1987

[51] Int. Cl.[5] ..... A47B 81/00

[52] U.S. Cl. ..... 312/214; 312/341.1; 62/408; 62/382

[58] Field of Search ..... 62/408, 382, 187; 312/296, 336, 341 R, 214

[56] References Cited

U.S. PATENT DOCUMENTS

| | | | |
|---|---|---|---|
| 319,363 | 6/1885 | Weitz | 62/408 |
| 736,449 | 8/1903 | Shanklin et al. | 62/382 X |
| 1,137,073 | 4/1915 | Morris | 312/122 |
| 2,237,820 | 4/1941 | Hill | 312/290 X |
| 2,709,900 | 6/1955 | Zearfoss | 62/408 X |
| 2,763,526 | 9/1956 | Falek | 312/290 |
| 2,773,362 | 12/1956 | Scheitlin | 312/341 |
| 2,859,495 | 11/1958 | Roberts | 312/296 X |
| 3,169,806 | 2/1965 | Beeck | 384/19 |
| 3,416,850 | 12/1960 | Hilfinger et al. | 312/330 |
| 3,473,345 | 10/1969 | Pfeiffer et al. | 62/408 |
| 3,716,283 | 2/1973 | Little | 312/330 |
| 4,013,434 | 3/1977 | Kronenberger et al. | 62/408 X |
| 4,173,378 | 11/1979 | Hanson et al. | 312/296 |
| 4,557,118 | 12/1985 | Pink et al. | 62/408 |

*Primary Examiner*—Joseph Falk
*Attorney, Agent, or Firm*—Foley & Lardner

[57] ABSTRACT

A comestible storage compartment for a refrigeration unit including a drawer slidably received in a supporting frame. The drawer is molded in the form of a tub having a bottom wall, side and end walls and a front wall lip. A front wall panel is disposed in a free standing relationship on the front wall lip approximate the forward edges of the side walls. A front wall cover is disposed over the front wall panel and is secured to the forward edges of the side walls to hold the panel on the lip.

A lateral flange projects outwardly from the side walls and includes a downturned lip for defining a drawer track channel. Inwardly directed ribs extend longitudinally from the drawer frame and are disposed for spaced flow interrupting relationship with the lip on the lateral flanges.

The drawer is stabilized in the track channels by forming one of the track rollers with a lateral dimension approximately equal to that of the track channel on the frame and the other track roller with a lateral dimension less than that of the track channel.

The drawer rollers include a molded roller with a circular body and a shank having a central aperture. A crowned insert is disposed in the aperture which includes a shaft having a length greater than the length of the aperture and a radial flange to isolate the shank from the side wall.

25 Claims, 3 Drawing Sheets

COMESTIBLE STORAGE COMPARTMENT FOR REFRIGERATION UNIT

TECHNICAL FIELD

The present invention relates, generally, to comestible storage compartments for a refrigeration unit and, more especially, to storage compartments for the fresh food side of a domestic refrigerator. More particularly, the present invention concerns comestible storage compartments which are substantially sealed to prevent circulation of ambient when in the closed configuration, but which permit controlled air circulation at the election of the user. Accordingly, the present invention relates as well to regulated environment comestible storage compartments which are adaptable to general purpose storage drawers or crisper drawers for perishable comestibles such as vegetables.

DESCRIPTION OF THE BACKGROUND ART

Food refrigeration systems, such as the conventional household refrigerator, have evolved to a high degree and the art has become quite mature. Much as been done over the decades since the now commonplace electric refrigerator was introduced commercially, providing great convenience to household or commercial users in the storage of comestibles or similar perishable items. Cooling is zoned not only between the fresh food and freezer compartments of the unit but also within the fresh food compartment as well to optimize the effective storage life of perishable edible products.

It is known that different varieties of comestibles demand different storage environments to maximize storage life. In addition to measures taken to assure adequate refrigeration temperatures, certain varieties of food products demand relatively closely regulated humidity as well; an important consideration since the circulating chilled air within the fresh food compartment of a typical refrigeration unit is ordinarily quite dry. Some food products are able to tolerate, and perhaps thrive on, low humidity cold air. Other foods require a much more controlled environment. Fresh vegetables, for example, are more or less susceptible to the desiccating effect of the chilled circulating air within a refrigerator and demand greater humidity than the relative humidity of the open food storage area. For this reason, specially constructed crisper drawers have been designed by refrigerator manufacturers and have usually been placed at or near the bottom of the fresh food compartment along with other drawers which are used for storing comestibles not as sensitive to the dry air conditions existing within the unit. Consequently, certain drawers are designed and/or designated specifically as "crisper drawers," whereas others may be designed or utilized with greater general utility in mind.

There have been attempts in the past to provide optimized environmental conditions for humidity-sensitive comestibles. For example, a humidity controlled pan assembly for a household refrigerator is disclosed in U.S. Pat. No. 4,250,719. That patent describes the worthwhile benefits of isolating sensitive foodstuffs from the desiccating effect of circulating air and the desirability of controlling humidity within an isolated compartment. That patent also describes a humidity controlled assembly including a storage pan having an open top and a stationary cover inside the refrigerator to receive the pan. A cover panel within the stationary cover may be manipulated by a moveable control mechanism and associated linkage which is used to move the cover panel back and forth along the top of the pan. The user may, accordingly, increase or decrease the amount of ventilation within the storage pan and, in turn, control the humidity therein. A conceptually similar approach is suggested in U.S. Pat. No. 4,013,434, which concerns a hydrator drawer cover with an adjustable moisture control damper. In that instance, adjustable side vents permit the user to vary the amount of moisture within a food storage drawer. The moisture level is controlled by a damper and an integral hinge pin with cooperative flexible, arcuate fingers extending through the adjustable vents. The fingers have surfaces for engaging the edge portions of the associated vents to impart positional stability thereto, for selectively rotating the damper into any one of a plurality of angularly related positions. This control facilitates circulation of ambient within the drawer. As will be appreciated from the brief description of such devices set forth above, these approaches tend to be relatively complicated from a mechanical point of view.

Other suggestions to solve the problem of ambient regulation have sought to provide a sealed enclosure for perishable comestibles without particular regard for the ability to control the humidity therein. These suggestions have centered on tightly fitting seals, approaching hermetic seals, to safeguard the environment within the storage drawer. One such approach, generally described in U.S. Pat. No. 4,173,378, utilizes a sealed food storage drawer designed for generally airtight disposition within a conventional refrigerator. The described assembly includes a one-piece frame supporting a cover panel in a locked manner with seals, suitably affixed in the side members, and a rearward member of the assembly, such that the seal extends into the path of the drawer when the drawer is moved from its open position to its closed position. Thus, when the drawer is in its closed configuration, the seal abuts the side and rear walls of the drawer. A front cross-frame member separately includes means for effecting a sealed relationship with the front wall of the drawer when it is in its closed configuration to complete the airtight environment. A similar objective is sought by the drawer tray installation described in U.S. Pat. No. 2,763,526. That patent discloses means for automatically sealing the drawer tray against the ingress of air or dust when it has been moved into its closed position in the refrigerator. That is achieved, in part, through the use of a cover plate for the drawer which is affixed in the supporting cabinet of the refrigeration unit in such a position as to overlie entirely the sliding drawer or tray when it is closed. While the drawer is in the closed position, the cover becomes engaged with the upper edges of the drawer in a snug or airtight relationship. Other patents of general or background interest along these lines include U.S. Pat. No. 1,137,073, U.S. Pat. No. 2,237,820, U.S. Pat. No. 2,306,802, and U.S. Pat. No. 3,473,345.

Viewing the foregoing patents as generally representative of the existing art, it becomes apparent that there is considerable room for improvement in the design of storage compartments which provide efficient storage of perishable comestibles. For example, those devices which seek to attain a nearly hermetic seal lose important adaptibility in the refrigerator environment because they are single purpose devices which rely on fixed sealing members. On the other hand, those approaches which admit of some measure of adjustability achieve that objective at the expense of simplicity of design; the highly complicated structural arrangements hamper not only their use and servicability but dramatically increase manufacturing costs. Thus, individually or collectively, a significant penalty is paid, ultimately by the user, in terms of the convenience and expense of the refrigeration unit itself.

Accordingly, there is a need for an improved storage compartment for perishable comestibles in a refrigeration unit which is of simple design with respect to manufacture and use, while at the same time being versatile and efficient.

SUMMARY OF THE INVENTION

The present invention responds to the long-felt needs noted above. The food storage compartment of the present invention possesses the elegance of simplicity and design, while achieving high versatility in its use as either a vegetable crisper drawer, wherein high humidity is desired, or as a drawer of general utility, wherein the humidity environment and/or control are of relatively less importance. The storage compartment of this invention is advantageously of a molded construction having mechanically interlocking parts. This reduces the cost of manufacture as well as likelihood of failure during use due to the integrity of design. The storage compartment of the present invention enjoys a positive, albeit nonhermetic, seal when in place in the refrigeration unit. At the same time, it may be easily removed from the unit for cleaning when necessary.

The foregoing, and other advantages, are achieved in the present invention by use of a comestible storage compartment having a drawer for cooperative sealing engagement within the refrigeration unit which is slideably received on a drawer frame for movement between an open and a closed position, which drawer comprises a generally unitary, molded drawer tub having a bottom wall, upstanding side and end walls, and a front wall lip; a front wall panel disposed in free standing relationship on the front wall lip proximate the forward edges of the sidewalls; and a front wall cover means disposed over the front wall panel and secured to the drawer tub by mechanical interlocking means. That combination forms a drawer permitting access through an open top, the front wall panel means and front wall cover means collectively comprising the front wall of the drawer while the remaining structure is provided by the tub. The storage compartment of this invention further comprises sealing means for reducing ambient circulation through the open top when the drawer is in its closed configuration. The storage compartment of the present invention additionally comprises ventilation means in the front wall for permitting controlled ambient flow, when desired, into and through the drawer when it is in its closed configuration.

The front wall panel is preferably a generally rectilinearly panel having transverse side edges and lateral top and bottom edges; it also includes a transverse track and at least one ventilation aperture formed within the zone of that track. The ventilation means comprises a slide cooperatively received within the track, which includes at least one ventilation aperture for selective, coincident registration with the aperture in the front wall panel. Preferably, there are a plurality of such apertures which may be registered in order to permit ambient circulation. Thus, the ventilation means may be closed to preclude circulation entirely, or the apertures partially overlapped over a range from fully open to fully closed to control the volume flow of ambient into and within the otherwise generally sealed drawer.

The drawer tub is formed with lateral flanges projecting outwardly of the side and end walls. Roller means extend outwardly of each of the side walls proximate the juncture thereof with the end walls. A drawer frame is comprised of a track means for receiving the drawer roller means and guiding the same as the drawer is moved between open and closed positions. Additionally, track roller means positioned proximate the track means on the drawer frame are configured to mate with the lateral flanges of the side walls for stabilizing the drawer during movement. Preferably, those lateral flanges at the side walls include a downturned lip to provide track channels within which the track roller means are to be received. Most preferably, one of the track roller means is dimensioned to interfit closely with the lateral dimension of the track channel with which it cooperates while the other track roller has a width somewhat less than the corresponding track channel dimension. Accordingly, the wider roller provides positive tracking action during movement of the drawer while the narrow roller tolerates normal manufacturing deviations to preclude binding of the drawer during use.

Sealing of the compartment during use is positive, although it is not hermetic or airtight. The drawer slides within the drawer frame beneath a cover plate which is positioned proximate the top open (access area) when the drawer is in its closed configuration. A rear seal is positioned to interfit with the laterally projecting flange of the end wall. A front seal is positioned to engage the front wall of the drawer as well. A rib, extending longitudinally of the drawer frame along either side of the drawer is disposed for spaced, flow interrupting relationship with the lateral flanges of the side walls when the drawer is in its closed configuration. The drawer is moved into the refrigeration unit along the track means in a somewhat upwardly biased orientation due to the cooperative nature of the track means of the drawer frame and the roller means on each of the drawer and frame members. When fully received within the unit, the drawer drops slightly downward. This places the rib and edges of the downturned lips of the lateral side wall flanges in spaced relationship. They remain sufficiently close, however, to preclude direct flow of ambient into the drawer. By virtue of the tortuous path required for ingress or egress, a substantial seal is achieved along the side edges to augment the positive seals at front and rear edges.

Other advantages of the present invention will become apparent, and a fuller appreciation of its mode of construction and operation will be gained, upon an examination of the following detailed description of preferred embodiments when taken in conjunction with the figures of the drawing.

DETAILED DESCRIPTION OF PREFERRED EMBODIMENTS

The present invention relates, generally, to comestible storage compartments for use in refrigeration units and, more especially, to an improved storage compartment of broad versatility allowing it to function either as a crisper drawer or as a general utility drawer in a domestic refrigerator or the like. Accordingly, the present invention will now be described with reference to certain preferred embodiments in the foregoing context but those skilled in the art will appreciate that such a description is meant to be exemplary only and should not be viewed as limitative.

Figure 1:
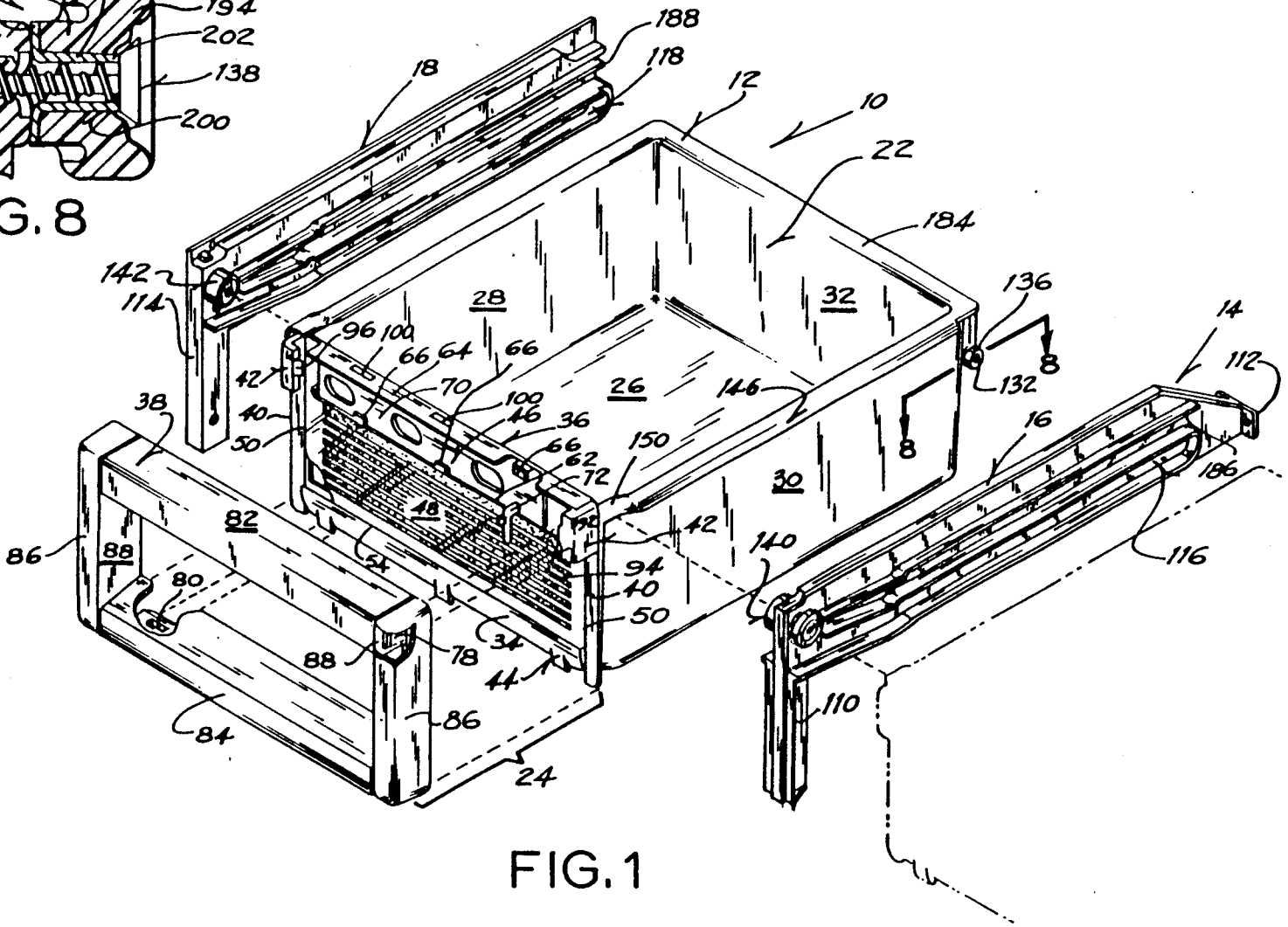
FIG. 1 is an exploded, isometric view of a comestible storage compartment for a refrigeration unit in accordance with the present invention, showing in phantom lines the manner in which a cooperative drawer would be associated with a storage compartment in the environment of a conventional household refrigerator.
Figure 5:
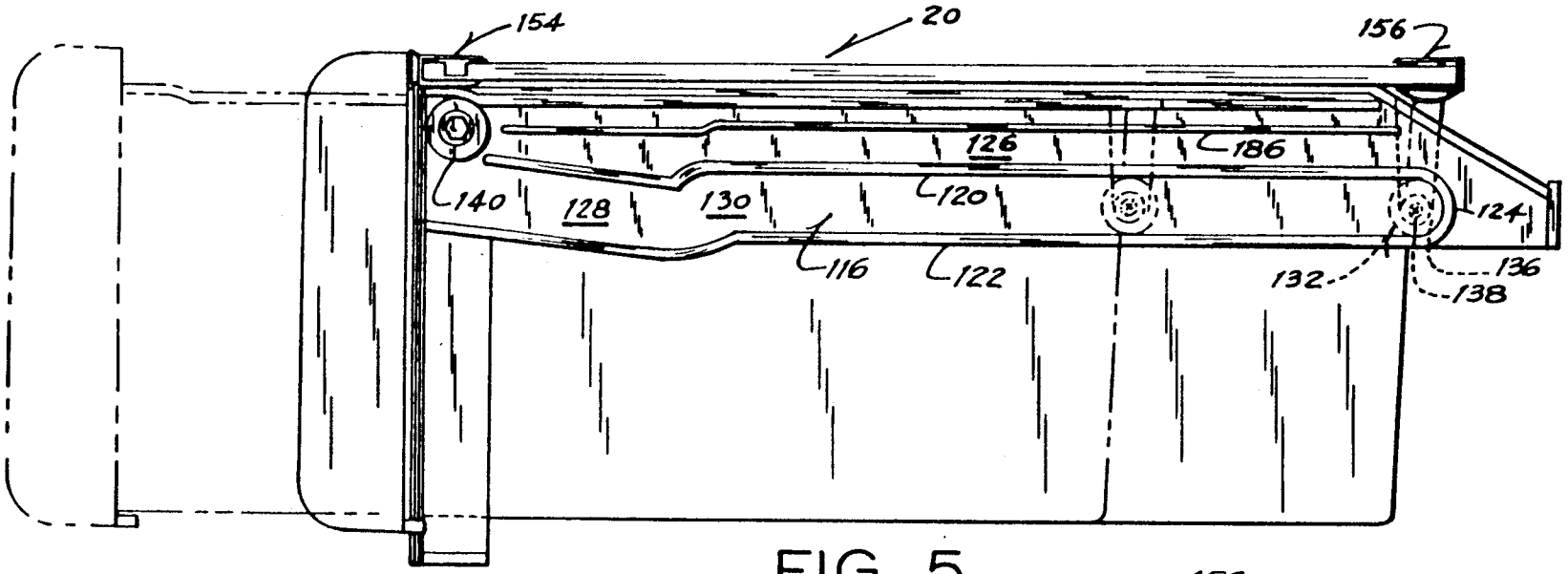
FIG. 5 is a side elevation view of a comestible storage compartment in accordance with the present invention, shown in its closed configuration in full lines and in a partially open configuration in phantom lines.

Referring to the figures of drawing, in each of which like parts are identified with like reference numerals, a comestible storage compartment for a refrigeration unit is identified generally as 10 in FIG. 1. The storage compartment itself is comprised of two subassemblies, a drawer designated generally as 12 and a drawer frame designated generally as 14. In the illustrated embodiment, there are a pair of storage compartments 10, the left hand compartment being illustrated in full lines and right hand compartment suggested in fragmentary phantom lines, although some models of home refrigerators may have only one row or bank of compartments. Accordingly, as respects the illustrated embodiment, the drawer frame 14 includes a center frame 16 and an outboard or left frame 18 which are spaced to receive drawer 12. The drawer 12 is configured for sliding receipt in cooperation with the drawer frame 14 (in this case center frame 16 and outboard frame 18) between a closed configuration and an open configuration as illustrated in FIG. 5. When in the closed configuration, the drawer 12 is substantially sealed to prevent circulation of ambient while allowing for regulated admission of ambient through a ventilating means as will be described in detail below. To facilitate this objective, the drawer, when in its closed configuration, has its top covered by a plate identified generally as 20 in FIG. 5. In most instances this cover plate will be either a tempered glass or high impact polymer of sufficient integrity to span the frame members 16 and 18 without bowing or otherwise obstructing free movement of the drawer 12 within the frame 14.

The drawer 12 is of a generally molded construction comprised of a tub designated generally as 22 and a front wall assembly designated generally as 24. In the preferred embodiment, the tub is shown as a unitary molded unit having a bottom wall 26, side walls 28 and 30, and an end wall 32. The tub also includes a front wall lip 34 which is formed as a slight upper return from the bottom wall 26. The front wall lip serves several functions. As will become apparent from the discussion below, it plays a key role in affixing the front wall panel to the tub itself. Additionally, however, it provides other advantages which increase the useful life of the drawer and increase its utility to the user. For example, if an item which is placed in the drawer were to slide forward in the event the drawer is forcefully opened, the front wall lip would absorb much of the shock and prevent damage to the front wall assembly. Not only does this protect the front wall from damage, but it helps to assure that the integrity of the sealing means about the front wall cover will not be compromised. Also, in the event that the contents of any item kept in the drawer should spill, the front wall lip will prevent seepage from the drawer into the refrigerator compartment.

The front wall assembly 24 is comprised of a front wall panel 36 and a front wall cover means 38. The front wall panel is disposed in free standing relationship on the lip 34 proximate the forward edges 40 of the side walls 28 and 30. The front wall cover means 38 is disposed over the panel 36 and is secured to the drawer tub by a plurality of mechanical interlocking means 42 and 44, described below. When snap fitted with the interlocking means, the front wall cover means 38 affixes the front wall panel 36 to the drawer tub to yield a drawer permitting access through an open top, thus completing the overall drawer geometry.

The storage compartment of the present invention is advantageously sealed when in its closed configuration in a refrigeration unit. As noted summarily above, the versatility of the storage compartment of the present invention is materially enhanced by including ventilating means which permits controlled circulation of ambient through the sealed interior of the drawer 12, in the sense that differentials in vapor pressure or the like will equilibrate inside and outside the compartment. This is achieved by ventilating means identified generally as 46, described in detail below.

Figure 2:
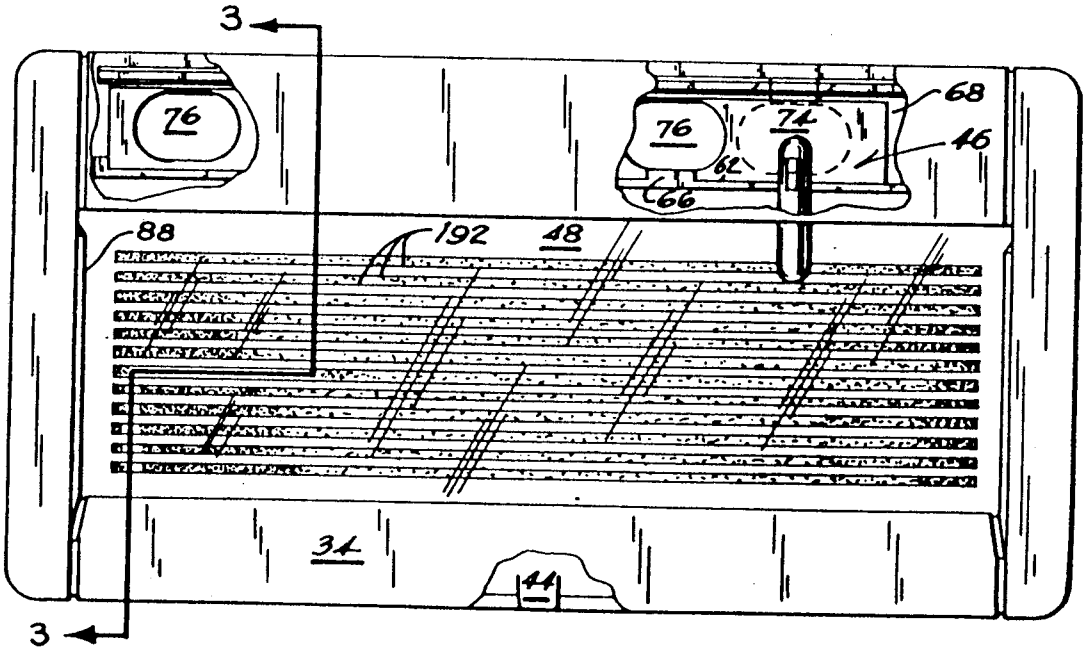
FIG. 2 is a front elevation view of the drawer of the comestible storage compartment of FIG. 1, with parts broken away to show a portion of the ventilating means and an element of the mechnical interlocking structure by which the drawer is assembled.
Figure 3:
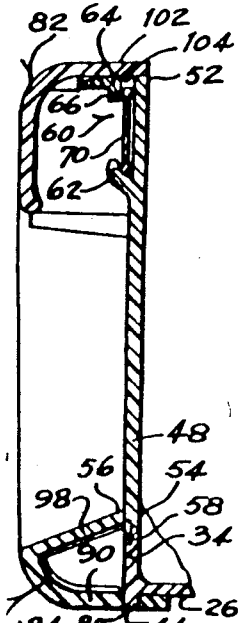
FIG. 3 is a sectional view, taken substantially along the line 3—3 of FIG. 2.

In the illustrated embodiment, the front panel 36 is a generally rectilinear panel 48 having transverse side edges 50 and lateral top and bottom edges 52 and 54, respectively, as best viewed in FIG. 3. The bottom edge 54 is stepped at 56 to interfit with a step 58 on the front wall lip 34, as best viewed in FIG. 3. The upper region of the panel 48 includes a transverse channel 60 comprised of an outwardly projecting lip 62 along the bottom edge of the channel, and a wider flange 64 disposed outwardly from the top edge 52 of the panel. A plurality of protuberances 66 are formed proximate the channel 60 and are spaced from the panel 48 to form the general contours of a slot 68 as shown in FIG. 2. A slide 70, in the form of a generally rectilinear web, is disposed within the slot 68 for movement leftwardly and rightwardly. A handle 72 facilitates this motion. Thus, the web 70 moves within the slot 68 confined by the protuberances 66 as directed by the user through manipulation of the handle 72. A series of apertures 74 is formed in the panel 48 and a eorresponding series of apertures 76 is formed in the slide of web 70. In FIG. 1, the apertures 74 and 76 are shown in registration. This permits the ingress or egress of ambient into and out of the interior of the drawer 12. In FIG. 2, these apertures are shown out of registry. This is accomplished through movement of the slide 70 thereby preventing flow of ambient. This arrangement of registering apertures comprises the most preferred embodiment of the ventilating means 46 within the front wall panel.

The front wall panel 36 is secured in position relative to the tub 22 by the front wall cover means 38. The tub is provided with the interlocking means 42 and 44 which are designed to interfit with cooperative recess means 78 and 80, respectively, in the front wall cover. More specifically, the front wall cover means 38 is comprised of a top arm 82, having a generally arcuate profile as best viewed in FIG. 3, a bottom arm 84 having a generally "U"-shaped profile, and opposed side arms 86, each likewise having a generally "U"-shaped profile. The recess means 78 are formed in the inner leg 88 of the side arms 86 and the recess means 80 are formed in the bottom leg 90 of the arm 84. In each case, the recess means are formed as generally rectilinear apertures as best viewed in FIGS. 1 and 3. The interlocking means 42 are each comprised of an outwardly disposed arm 92 having an inwardly directed laterally disposed return leg 94. A protuberance 96 having a re-entrant geometry is included on the inward face of each of the return legs 94. These protuberances are configured for captured disposition within each of the recess means 78 in the front wall cover member 38. Likewise, the interlocking means 44 includes a generally rectilinear protuberance designed for a cooperative interfitting relationship within the recess means 80.

The steps required to secure the front wall panel assembly to the tub are as follows: The first step is to position the slide 70 into the transverse channel 60 in the upper region of panel 48. In the illustrated embodiment, this is accomplished by inserting the slide 70 into the slot 68 formed by the protuberances as described above, and moving the slide laterally until it reaches a stop positioned at the distal end of the channel. The front wall panel cover means 38, when in place, cooperates with the channel 60 of the panel 48 to prevent the slide 70 from becoming disengaged during use. The front wall panel 36 is then secured in position on the tub by aligning the mating steps 56 and 58, and then disposing the protuberant elements 44 within the cooperative apertures or recess means 80 along the bottom edge of the front wall cover means 38, with the top edge angled slightly outwardly. The cover member 38 is then pivoted toward the tub with the interlocking means 42 received interiorly of the "U"-shaped channel of the side arms 86. Finally, sufficient pressure is applied to the front wall cover member 38 to force it toward the tub against the face of the angled protuberances 96 until the two snap together within the generally rectilinear aperture means 78. In that position, the top of the front wall cover member 38 is positively secured. The side edges of the panel 48 are firmly secured against the edges 50 of the tub 22 as a result of vertical pressure being applied against the edge by the inner legs 88. The interior return leg 98 of the bottom arm 84 exerts a lateral force across the entirety of the panel 48, firmly and positively restraining that edge of the member as best viewed in FIG. 3. The top flange 64 of the panel means 36 is formed with a plurality of detents or recesses 100, shown in FIG. 1, while the top leg 102 of the arm 82 is formed with slight protuberances 104. Together these protuberances and notches lock the top edge of the front panel firmly in place once the assembly is complete. This configuration not only assures a secure fit but also prevents the assembly from rattling when in use.

Figure 4:
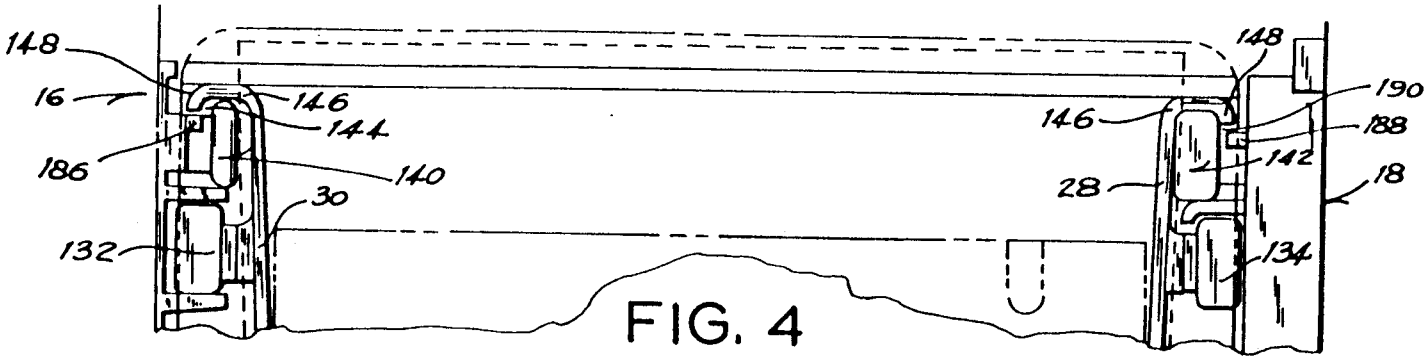
FIG. 4 is a front elevation view of the drawer frame of the comestible storage compartment shown in FIG. 1, here illustrating in phantom lines the cooperative interrelationship between that drawer frame and the drawer member.

When in use, the drawer 12 cooperates with the drawer frame 14, permitting movement of the drawer 12 between its closed configuration, as shown in full lines in FIG. 5, and its open configuration as shown in phantom lines in that Figure. The frame means 14 in the preferred embodiment includes a center track frame 16, which supports the opposed sides of a pair of drawers 12, and an outboard track frame 18 which lies adjacent the wall of the refrigeration unit. For the sake of illustration, the drawer and associated frame of FIGS. 1 and 5 are shown as a left hand assembly, whereas FIG. 4 shows a right hand assembly for a complete appreciation for the mirror-imagery involved in the present design.

The center track frame 16 is positioned, for receipt of the drawer 12, on a raised leg 110 which is suitably affixed to the structure of the refrigeration unit. The drawer frame is secured to the rear wall or other supporting structure by a mounting bracket 112. A similar leg 114 supports the track 18 and is secured, preferably, directly into the side wall of the refrigerator. A pair of opposed channels are formed in the track means; a channel 116 in the track means 16 and a channel 118 in the track means 18. In each case, the channel is formed by an array of raised ribs projecting laterally from the face of the track frame. As best illustrated in FIG. 5, upper rib 120, lower rib 122, and an arcuate rib 124 projecting outwardly of the face 126 of the frame 16 collectively combine to form the channel. Preferably, the entryway to the channel 116 (and also 118) is somewhat downwardly angled as shown in the channel region 128. The result is that the main portion of the channel can only be accessed through a transition zone 130.

The drawer 12 includes opposed drawer roller means which are designated as 132 on the inboard side (mating with the channels 116) and as 134 on the outboard side (mating with the channels 118). These roller means, described in greater detail below, include a generally cylindrical roller member 136 which is free to rotate about an axle means 138, best viewed in FIG. 8, to provide rolling support for the drawer 12 as is moves along the track means 14. The cylindrical roller members 136 are configured to have a diameter closely matching the internal separation of the ribs 120 and 122, as seen in FIG. 5, so that there is positive tracking of the roller members within the channels during movement of the drawer. The drawer 12 is inserted within the track means 14 by placing the rollers 132 and 134 into the respective track channels 116 and 118. As described above, the rollers must enter the channel through an introductory angled channel region 128. The drawer will typically be angled somewhat upwardly at its front end to introduce those rollers into the entryway of the channel. As the rollers reach the transition region 130, the drawer will be lowered to accommodate the arcuately sloping zone leading to the main channels 116 and 118, thus completing that operation. When the drawer is fully closed, the roller means will nestle in proximate engagement with the arcuate end ribs 124 which define the depth of the channels in such a manner to ensure positive closure and sealing of the drawer when in the closed configuration. When the drawer is opened, the roller will traverse the channel 116 until arriving at the transition region 130 where, under normal usage conditions, it will stop since further forward movement of the drawer requires an upward tilting motion to move through that transition zone into the angled throat area 128. This prevents the undesired or inadvertent removal of the drawer during normal use.

The drawer 12 is additionally supported during its motion by a plurality of track rollers, including an inboard track roller means 140, associated with the center frame 16, and an outboard track roller means 142, associated with the outboard frame 18. These roller means, 140 and 142, cooperate with the drawer track channel means, generally shown as 144 in FIG. 4, which are formed about the upper side walls of the drawer 12. In each case, the channel means 144 is comprised of a laterally, outwardly directed flange 146 and a downturned lip 148 which provides dimensional definition to the channel. These are formed as a generally continuous extension of the side wall of the tub 22. As is evident from FIG. 4, the roller means 140 and 142 are received interiorly of the channels and support the upper edge of the drawer 12 during its movement within the overall frame means 14. As is also evident from that Figure, the inboard roller 140 is narrower than the width dimension of the channel 144 whereas the outboard roller 142 relatively closely approximates the width dimension of its corresponding channel. The wider roller assures positive tracking of the drawer during its movement inwardly and outwardly of the refrigerator because there is a lesser tendency for twisting or other unwanted lateral movement of the drawer. In contrast, the narrower roller permits minor manufacturing vagaries to be anticipated without any undesirable effects. When used in combination, as in the present invention, it is possible to achieve both objectives: positive tracking and compensation for minor manufacturing variations.

Another remarkable feature of the cooperation between the track roller means and channels 144 is the positive closure that is achieved when the drawer is fully seated in the closed configuration. As will be seen below, this also enhances the sealing of the drawer when it is closed. This aspect of the invention is achieved, in part, by an upwardly divergent ramp 150 formed at the forwardmost end of the flange 146, as best viewed in FIGS. 5 and 6. The ramp has a somewhat arcuate sloping geometry which merges to the flange 146 at a juncture 152. The distance between the juncture 152 and the front of the drawer 12 is greater than the radius of the roller member of the corresponding roller means 140 and 142. Accordingly, as that juncture rolls over center, the ramp comprises a type of detent means in cooperation with the associated roller. Several things occur at that moment: (1) the drawer closes tightly in its sealed or closed configuration; (2) the drawer is positively closed in the sense that it requires a slight additional force to raise the juncture 152 over the center of the corresponding roller and, accordingly, the drawer tends to remain in its closed position in the absence of additional force; and (3) by virtue of the height difference between the bottom of the channel 144 in the region of the flange 146 relative to that in the region of the ramp 150, the drawer tends to settle downwardly when in a closed position, further augmenting sealing as will be described below.

The drawer assembly of the present invention enjoys a major advantage of versatility. It may be used as a crisper by closing the ventilating means 46 to maintain appropriate humidity within its environment. It may also be utilized as a general purpose or utility drawer without regard to such humidity control. That advantage is achieved, in part, by appropriate seals about the open top of the drawer when it is in its closed configuration.

Figure 7:
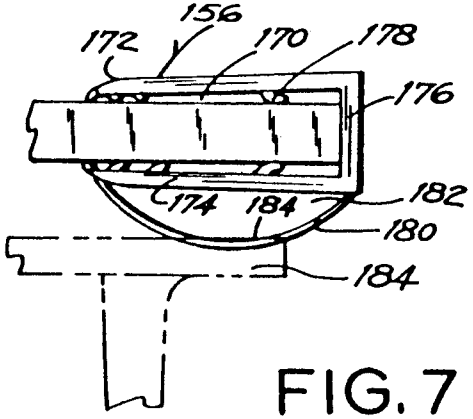
FIG. 7 is an enlarged fragmentary view, similar to FIG. 6, but here showing the rear seal with the drawer; and, FIG. 8 is a sectional view, taken substantially along the line 8—8 of FIG. 1, showing a roller construction.
Figure 6:
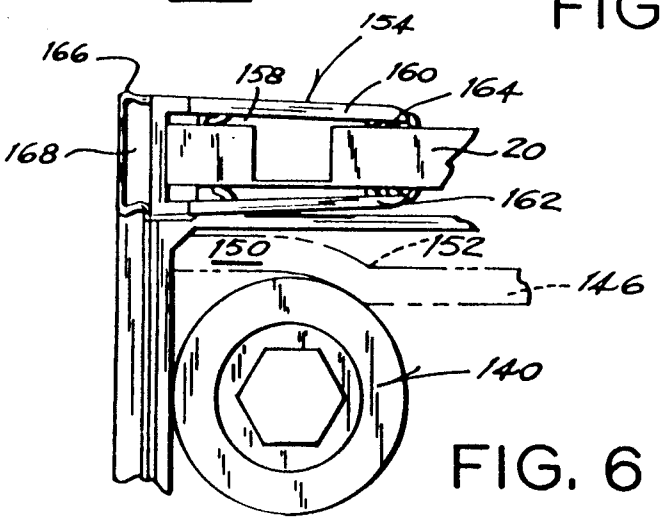
FIG. 6 is an fragmentary, enlarged view of the front of the storage compartment, illustrating both the front seal and a detent which secures the drawer in the closed configuration.

The cover plate 20 serves to close the open top of the drawer 12. The cover plate 20 carries a forward seal or gasket member 154 and a rearward seal or gasket member 156 as best shown in FIGS. 5–7. The forward seal 154 has an open throat 158 defined by upper and lower webs 160 and 162, respectively. The throat 158 is configured to allow the seal 154 to be slipped over the cover plate 20. A plurality of resilient fingers 164 are included along the interior surfaces of each of the webs 160 and 162 to augment the grasping effect of the throat 158. The seal 154 terminates at its forward end in a distendable and resilient bellows member 166 confining a plenum 168. This active region of the seal 154 is designed to mate with the upper face of the front wall assembly 24 when the drawer is closed, as best viewed in FIG. 5. This arrangement effectively seals the frontal portion of the drawer against circulation of ambient at that region. The rear seal 156 is generally similar. It is formed with a throat 170 of a generally "U"-shaped configuration defined by upper and lower webs 172 and 174, and an end web 176. The grasping power of the seal is likewise augmented by a plurality of resilient fingers 178 which are bent upon installation of the seal 156 over the cover plate 20 and intensify the gripping action when in service. A downwardly depending bellow member 180 confines a plenum 182, but in this instance proximate the lower web 174. This distensible and resilient sealing element is positioned to cooperate with a flange 184 extending outwardly of the end wall 32 of the drawer tub 22 when the drawer is in its closed configuration as is best envisioned with reference to FIGS. 5 and 7. Thus, the seals 154 and 156 effectively close the front and rear portions of the drawer 12, preventing circulation of ambient in those regions.

Sealing the side walls of the drawer 12 is somewhat problematic. Achieving hermetic seals along the four edges of the drawer adds greater complexity to the design of the unit, and often results in the sacrifice of longevity. This follows from the fact that the closely cooperating parts necessary for sealing efficiency will tend to wear over time as the drawer is repeatedly opened and closed. Avoiding the frictional contact created by that design approach contributes even more to the significant complexity of design which is disadvantageous from both the points of view of manufacturing and later use and servicability. The present design provides enhanced sealing at the side edges, albeit short of a hermetic seal, but nonetheless one of entirely adequate efficiency capable of maintaining appropriate moisture within the drawer 12 when it is desired for use as a crisper compartment.

The track frames 16 and 18 are formed with outwardly projecting sealing ribs, identified as 186 on the track frame 16, and 188 on the outboard frame 18. These ribs, one of which is shown most distinctly in FIG. 4, project outwardly of the faces of the track frames toward the side walls of the drawer 12. The sealing ribs are dimensioned to extend close to the outer lateral projection of flange 146 and lip 148 at the upper edge of each side wall. This leaves a slight gap 190 between the downturned lip 148 and the sealing rib 188. The transverse dimension of that gap is controlled by the placement of the rib 188 relative to the depth of projection of the lip 148. As can be seen best in FIG. 5, the sealing rib tends to follow the general geometry of the track channel in which the drawer rides. Accordingly, as the drawer moves rearward into the track channel toward its closed configuration (dropping somewhat downwardly when the forward ramps on the track channels move over center of the track rollers), the dimension of the gap 190 tends to close. Although this will not result in the formation of an air-tight seal along those edges, the tortuous path required for ambient to circulate into or out of the interior of drawer 12 substantially precludes ease of flow of ambient, making it possible to maintain the desired humidity condition within the drawer. Thus, the design of the present invention produces a highly efficient sealing mechanism while at the same time retaining the elegance of simplicity. This makes it commendable both from the manufacturer's point of view and then, later, from the user's point of view.

The storage compartment 10 is very easily manufactured using straightforward production techniques with a minimum of scrap. The tub 22 is preferably of a unitary, molded construction and most preferably a molded, one-piece tub of ABS polymer. The same is true of the front wall cover 38, the drawer frames 14, and the sliding web of the ventilating means 46. The front wall panel 36 is also of molded construction, but in this instance the preferred material is a polycarbonate to permit the user to view, generally, the contents of the drawer 12 when in the closed configuration. Due to the fact that transparent polycarbonates are generally prone to scratching or other marring, in this instance the front wall panel has been etched with transverse lines 192. These provide a slight visual barrier which will distract the user's eye but still permit viewing the contents of the interior.

Figure 8:
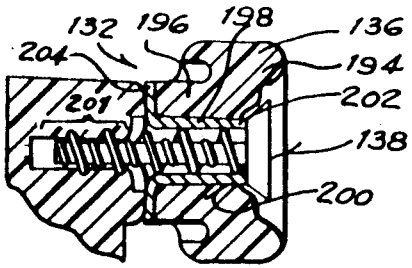

The assembly of the present invention is further noteworthy for the manufacturing convenience found in the construction of the various roller means such as the roller 132 illustrated in FIG. 8. Each of the rollers, such as roller member 136, has a circular geometry; the roller here illustrated has an active roller element 194 which engages the track of the drawer 12 and a stepped or reduced diameter shank 196. The roller 132 is secured to the supporting structure, which in this instance is a reinforced element proximate the juncture of the side wall 30 and end wall 32, by means of an axle 138, here shown as a threaded fastener. A metallic insert 200 is disposed within an aperture or bore 198 to form the center of the roller member. The fastener passes through the metal insert and into the tub, as shown at 201 in FIG. 8. The insert 200 is formed with a cylindrical shank 202 leading to a radial flange 204 having a diameter approximately equal to that of the shank 196. However, the length of the insert 200 is somewhat longer than that of the aperture 198 through which it is inserted. Accordingly, the shank 202 projects slightly outwardly from the aperture or bore 198. The roller has a countersunk region within which it receives the head of the threaded fastener 138. When tightened into place, the fastener compresses the insert 200 but does not bind or otherwise engage the roller element. Consequently, a race is formed by the metallic insert about which the outer roller element 194 may spin freely. All of the rollers comprising the assembly 10 have the same construction, differing only in the relative width dimension of the roller element 194. Thus, manufacturing is simplified while efficiency is maximized.

While the invention has now been described with reference to certain preferred embodiments, those skilled in the art will appreciate the various substitutions, modifications, changes and omissions may be made without departing from the spirit thereof. Accordingly, it is intended that the scope of the present invention not be limited by the foregoing description but be accorded the broadest interpretation available to the claims appended hereto.

We claim:

1. A comestible storage compartment for a refrigeration unit having a drawer for cooperative sealing engagement within said unit slidably received on a drawer frame for movement between open and closed positions, said drawer comprising:

(a) a generally unitary, molded drawer tub having a bottom wall, upstanding side and end walls, and a front wall lip;

(b) a front wall panel disposed in free standing relationship on said front wall lip proximate the forward edges of said side walls; and (c) front wall cover means disposed over said front wall panel and secured to said drawer tub by mechanical interlocking means, for affixing said front wall panel to said drawer tub to yield a drawer having an open top for access thereto, said front wall panel means and front wall cover means collectively comprising a front wall of said drawer.

2. The storage compartment of claim 1, further comprising sealing means for reducing ambient circulation through said open top when said drawer is in its closed configuration.

3. The storage compartment of claim 2, further comprising ventilation means in said front wall panel for permitting controlled ambient flow through said drawer when in said closed configuration.

4. The storage compartment of claim 3, wherein said front wall panel is a generally rectilinear panel having generally transverse side edges and lateral top and bottom edges, and includes a transverse track and at least one ventilation aperture formed within the transverse zone of said track, and further wherein said ventilation means comprises a slide received in said track including at least one ventilation aperture for selective coincident registration with said aperture in said front wall panel to establish a circulation path into said drawer.

5. The storage compartment of claim 3, wherein said drawer tub includes a lateral flange projecting outwardly of said side and end walls and drawer roller means projecting outwardly of each of said side walls proximate the junctures thereof with said end walls, said drawer frame comprising track means for receiving said drawer roller means and guiding the same as said drawer is moved between its open and closed positions and a track roller means configured to mate with the lateral flange of said side walls for stabilizing said drawer during movement.

6. The storage compartment of claim 5, wherein each of said drawer roller means is comprised of a molded roller with a body of generally circular cross section and a longitudinally extending shank, said roller having a central aperture therein; a crowned insert disposed in said aperture, comprising a cylindrical shaft having a length dimension greater than the wall of said aperture and a radial flange having a dimension approximately that of the shank of said roller, for isolating said shank from said side wall; and fixture means disposed through said shaft.

7. The storage compartment of claim 5, wherein said lateral flanges of said side walls include a downturned lip to define drawer track channels within which said track roller means are received.

8. The storage compartment of claim 7, wherein a first of said track roller means has a lateral dimension approximately equal to that of the drawer track channel and the second of said track roller means has a lateral dimension less than that of the drawer track channel.

9. The storage compartment of claim 7, wherein said drawer frame comprises inwardly directed ribs extending longitudinally of said frame and disposed for spaced flow interrupting relationship with said lateral flanges of said side walls when said drawer is in its closed configuration.

10. The storage compartment of claim 9, wherein said drawer track channels terminate at the forward end thereof in a raised track element for receiving said drawer roller means in a detent relationship and for positioning said rib in said flow interrupting relationship.

11. The storage compartment of claim 10, further comprising front and rear seals for mechanical engagement with the front wall and rear wall of said drawer.

12. A comestible storage compartment for a refrigeration unit comprising a drawer, slideably received in a supporting frame which permits said drawer to be moved between its opened and closed positions, which includes:

(a) a generally unitary, molded drawer tub comprised of a bottom wall, upstanding side and end walls, and a front wall lip, wherein said drawer tub includes a lateral flange which projects outwardly from said side and end walls, each of said side walls including a downturned lip depending from said lateral flange for defining drawer track channels, and which further includes drawer roller means projecting outwardly of each of said side walls proximate the junctures thereof with said end walls;

(b) a generally rectilinear front wall panel having generally transverse side edges and lateral top and bottom edges, and which further includes a transverse track and at least one ventilation aperture formed within the transverse zone of said track, said panel disposed in free standing relationship with said front wall lip proximate the forward edges of said side walls;

(c) ventilation means in said front wall panel comprising a slide received in said track including at least one ventilation aperture which cooperates with said ventilation aperture of said front wall panel through selective coincident registration to permit control of the flow of ambient through said drawer when in its closed configuration;

(d) front wall cover means disposed over said front wall panel and means for securing said front wall panel to said drawer to yield a drawer having an open top for access thereto, said front wall panel means and front wall cover collectively comprising a front wall of said drawer;

(e) sealing means for reducing ambient circulation through said open top; and (f) a drawer frame for supporting said drawer, comprising track channel means having a forward end and a rear end, said track channel means terminating at the forward end thereof in a raised track element for receiving said drawer roller means in a detent relationship when said drawer tub is in its closed configuration and for guiding said drawer roller means as said drawer is moved between its open and closed positions, inwardly directed ribs extending longitudinally from said drawer frame and disposed for spaced, flow interrupting relationship with said lateral flanges of said side walls when said drawer is in its closed configuration, and track roller means configured to mate with said lateral flanges of said side walls within said drawer track channels for stabilizing said drawer during movement, wherein the first of said roller means has a lateral dimension approximately equal to that of the track channel and the second of said track roller means has a lateral dimension less than that of the track channel.

13. The comestible storage compartment of claim 12, wherein said drawer roller means are comprised of:

(a) a molded roller with a body of generally circular cross section and a longitudinally extending shank, said roller having a central aperture;

(b) a crowned insert disposed in said aperture which is comprised of a cylindrical shaft having a length dimension greater than the side wall of said aperture, a radial flange having a dimension approximately that of said shank for isolating said shank from said side wall; and (c) fixture means for securing said roller means to said drawer tub through said shaft.

14. Drawer roller means comprised of:

(a) a molded roller with a body of generally circular cross section and a longitudinally extending shank, said roller having a central aperture;

(b) a crowned insert disposed in said aperture which is comprised of a cylindrical shaft having a length dimension greater than the side wall of said aperture, a radial flange having a dimension approximately that of said shank for isolating said shank from a support therefor; and (c) fixture means for securing said roller means to said support.

15. The drawer roller means of claim 14, wherein said fixture means comprises an axle, removably secured to said support.

16. The drawer roller means of claim 15, wherein said axle comprises a threaded fastener with a head which engages said crowned insert, whereby said radial flange is brought into frictional engagement with said support.

17. The drawer roller means of claim 14, wherein said shank has a diameter less than that of said body.

18. A comestible storage compartment for a refrigeration unit having a drawer for cooperative sealing engagement within said unit which is slidably received on a drawer frame and supported for rolling movement between its open and closed positions on drawer roller means, said drawer frame comprising:

(a) opposed frame members disposed in spaced relationship to receive said drawer and support same for cooperative rolling engagement therewith between an open position and a closed and sealed position;

(b) track channel means on each of said frame members for captured engagement of said drawer roller means on said drawer and guidance thereof during movement between said open and closed positions;

(c) track roller means affixed to said drawer frame; and (d) rib means projecting outwardly of said frame members toward said drawer for proximate ambient flow interrupting relationship with said drawer when in its closed positions, said drawer including a drawer tub which includes:

(e) a bottom wall, upstanding wall and end walls, and a front wall assembly;

(f) a lateral flange projecting outwardly of said side and end walls, wherein said lateral flange of said side walls includes a downturned lip to define drawer track channels within which said track roller means are received; and (g) a raised track element at the forward end of said drawer track channel for receiving said track roller means in a detent relationship with same, and for positioning said rib in a spaced, flow interrupting relationship with said lateral flange of said side wall.

19. The storage compartment of claim 18, wherein a first of said track roller means has a lateral dimension approximately equal to that of the track channel and the second of said track roller means has a lateral dimension less than that of the track channel each of which mate with said lateral flange of said side wall to cooperatively stabilize said drawer during movement.

20. The storage compartment of claim 19, wherein said front wall assembly is comprised of:

(a) a front wall lip;

(b) a front wall panel disposed in free standing relationship on said front wall lip proximate the forward edges of said side walls; and (c) front wall cover means disposed over said front wall panel and secured to said drawer tub by mechanical interlocking means for affixing said front wall panel to said drawer, to yield said drawer in which said front wall panel means and said front wall cover means cooperate to form a front wall of said drawer, and which has an open top for access thereto.

21. The storage compartment of claim 20, further comprising ventilation means for permitting controlled ambient flow through said drawer when in its said closed configuration.

22. The storage compartment of claim 21, wherein said front wall panel is a generally rectilinear panel having generally transverse side edges and lateral top and bottom edges, and which includes a transverse track disposed across a face of said front wall panel.

23. The storage compartment of claim 22, wherein said ventilation means is comprised of:

(a) at least one ventilation aperture disposed in said transverse track of said front wall panel; and (b) a slide received in said transverse track including at least one ventilation aperture which cooperates through selective coincident registration with said aperture in said front wall panel to permit control of the circulation path into said drawer when in its closed position.

24. The storage compartment of claim 23, further comprising sealing means for reducing ambient circulation through said open top when said drawer is in its closed configuration, wherein said sealing means includes front and rear seals for mechanical engagement with said front and rear walls of said drawer.

25. The storage compartment of claim 24, wherein said drawer roller means are comprised of:

(a) a molded roller with a body of generally circular cross section and a longitudinally extending shank, said roller having a central aperture;

(b) a crowned insert disposed in said aperture which is comprised of a cylindrical shaft having a length dimension greater than the side wall of said aperture, a radial flange having a dimension approximately that of said shank for isolating said shank from said side wall; and (c) fixture means for securing said roller means to said drawer tub through said shaft.

* * * * *